US008434342B2

(12) United States Patent
Stodd

(10) Patent No.: US 8,434,342 B2
(45) Date of Patent: May 7, 2013

(54) METHOD AND APPARATUS FOR FORMING A CAN SHELL

(75) Inventor: R. Peter Stodd, Vandalia, OH (US)

(73) Assignee: Container Development, Ltd., Dayton, OH (US)

( * ) Notice: Subject to any disclaimer, the term of this patent is extended or adjusted under 35 U.S.C. 154(b) by 0 days.

(21) Appl. No.: 13/506,092

(22) Filed: Mar. 26, 2012

(65) Prior Publication Data

US 2012/0186321 A1 Jul. 26, 2012

Related U.S. Application Data

(63) Continuation of application No. 12/287,479, filed on Oct. 9, 2008, now Pat. No. 8,141,406.

(51) Int. Cl.
*B21D 22/20* (2006.01)
*B21D 51/44* (2006.01)

(52) U.S. Cl.
USPC ..... 72/348; 413/56

(58) Field of Classification Search ..... 72/347–349; 413/8, 56, 62
See application file for complete search history.

(56) References Cited

U.S. PATENT DOCUMENTS 4,713,958 A 12/1987 Bulso, Jr. et al.
4,716,755 A * 1/1988 Bulso et al. ..... 72/349
4,808,052 A 2/1989 Bulso, Jr. et al.
4,955,223 A 9/1990 Stodd et al.
5,502,995 A 4/1996 Stodd
5,527,143 A * 6/1996 Turner et al. ..... 413/8
5,823,040 A 10/1998 Stodd et al.
5,857,374 A 1/1999 Stodd
6,658,911 B2 12/2003 McClung
6,968,724 B2 * 11/2005 Hubball ..... 72/348
7,143,623 B1 * 12/2006 Turnbull et al. ..... 72/348
7,302,822 B1 12/2007 Turnbull et al.
7,341,163 B2 3/2008 Stodd
7,478,550 B2 1/2009 Wynn et al.
7,500,376 B2 3/2009 Bathurst et al.
7,819,275 B2 10/2010 Stodd

* cited by examiner

*Primary Examiner* — Debra Sullivan
(74) *Attorney, Agent, or Firm* — Jacox, Meckstroth & Jenkins

(57) ABSTRACT

Can shells are produced with tooling installed on a single action mechanical press, and the tooling includes an upper retainer supporting a blank and draw die enclosing an outer pressure sleeve and an inner pressure sleeve surrounding a die center punch, all having air actuated pistons. The die center piston has an air reservoir connected by air passages which form air springs for the inner pressure sleeve, and the outer pressure sleeve receives the same controllable air as the reservoir or low pressure plant air supply. The inner pressure sleeve has a projecting nose portion which initiates the drawing of a cup and has contoured surfaces which mate with corresponding surfaces on a die core ring to form and clamp the chuckwall of the shell during downstroke of the press. A lower panel punch forms the center panel, panel wall and countersink of the shell during upstroke of the press.

4 Claims, 7 Drawing Sheets

METHOD AND APPARATUS FOR FORMING A CAN SHELL

RELATED APPLICATION

This application is a continuation of U.S. patent application Ser. No. 12/287,479, filed Oct. 9, 2008.

BACKGROUND OF THE INVENTION

This invention relates to the method and apparatus for forming a can shell from sheet metal or sheet aluminum, for example, such as the methods and apparatus or tooling disclosed in U.S. Pat. Nos. 4,713,958, 4,716,755, 4,808,052, 4,955,223, 6,658,911 and 7,302,822. The disclosures of these patents are herein incorporated by reference to supplement the detail description of the present invention.

In such tooling assembly or apparatus, it has been found desirable for the apparatus to be constructed for use in a single action mechanical press such as disclosed in above mentioned U.S. Pat. Nos. 4,955,223 and 7,302,822 and to avoid using a double action mechanical press, for example, as disclosed in above-mentioned U.S. Pat. Nos. 4,716,755 and 6,658,911. A single action high speed press is simpler and more economical in construction and is more economical in operation and in maintenance and can be operated effectively and efficiently, for example, with a stroke of 1.75 inch and at a speed of 650 strokes per minute. There are also many more single action high speed presses in use in the field than there are double action presses.

It has also been found desirable for the apparatus or tooling assembly to incorporate an inner pressure sleeve and an outer pressure sleeve and to operate both sleeves with air pressure, but avoid actuating the inner pressure sleeve with circumferentially spaced and axially extending springs, for example, as disclosed in U.S. Pat. No. 7,302,822 or the use of circumferentially spaced and axially extending pins, for example, as disclosed in U.S. Pat. No. 4,716,755. The high speed axial reciprocating movement of the pins and the single piston which actuates the pins create undesirable additional heat, and is difficult to produce an adjustable and precisely controllable axial force on the inner pressure sleeve with the use of compression springs.

It is further desirable to have a precisely controllable constant force exerted by the outer pressure sleeve on the sheet material to avoid thinning the material between the outer pressure sleeve and the die core ring during high speed operation of the press. Precisely controllable air pressure on the inner pressure sleeve is also desirable for holding the chuckwall of the can shell while forming the countersink, panel wall and center panel of the can shell without thinning the sheet metal. In addition, it is desirable to minimize the vertical height of the tooling assembly for producing can shells in order to accommodate more single action high speed presses existing in the field and to operate at higher speeds with less heat being generated so as to avoid the use of water cooled tooling components. After reviewing the above patents, it is apparent that none of the patents provide all of the above desirable features.

SUMMARY OF THE INVENTION

The present invention is directed to improved method and apparatus or tooling for high speed production of can shells and which provide all of the desirable features mentioned above. The tooling assembly of the invention is also ideally suited for producing a can shell such as disclosed in applicant's U.S. Pat. No. 7,341,163 and in applicant's published patent application No. US-2005-0029269, the disclosures of which are also herein incorporated by reference. The method and apparatus or tooling assembly of the invention are especially suited for use on a single action press and for producing uniform and precision can shells at a high rate of speed and with the minimum generation of heat in order to avoid thermal changing of the tooling assembly during operation.

In accordance with one illustrated embodiment of the invention, a can shell is formed by a tooling assembly including an annular inner pressure sleeve which is located within an annular outer pressure sleeve, and both of the sleeves have integral pistons within corresponding annular air piston chambers. The outer pressure sleeve is supported within an annular blank and draw die secured to an upper retainer mounted on an upper die shoe of a single action press. The retainer also supports a die center piston which may be supported for relative axial movement, and the die center piston supports a die center punch within the inner pressure sleeve. The die center piston has a center portion defining an air reservoir chamber supplied with air through a port at a controlled pressure. The air reservoir chamber is connected to the air piston chamber for the inner pressure sleeve by a plurality of circumferentially spaced elongated air passages. The air piston chamber for the outer pressure sleeve is supplied with air at a controlled substantially lower pressure through a separate port in the upper retainer.

The inner pressure sleeve has an annular nose portion which normally projects from the die center piston and initiates the draw of a cup within a die cut sheet metal disk held between the outer pressure sleeve and an opposing fixed die core ring supported by a lower retainer mounted on a fixed lower die shoe of the press. The nose portion of the inner pressure sleeve and the die core ring have mating contoured surfaces which form an annular chuckwall on the disk, and the die center punch cooperates with the inner pressure sleeve to complete the drawing of the cup which is engaged by a panel punch supported within the die core ring. The panel punch has a peripheral contoured surface which forms the center panel of the shell and also the annular panel wall and the annular countersink. In another embodiment of the invention, the air piston chamber for the outer pressure sleeve is connected by an air passage extending to the air reservoir chamber so that the air piston chamber for the inner pressure sleeve and the air piston chamber for the outer pressure sleeve receive the same controllable air supply pressure, thereby avoiding the need for two different air supplies at different pressures to operate the tooling assembly on the upper die shoe.

Other features and advantages of the invention will be apparent from the following description, the accompanying drawings and the appended claims.

DESCRIPTION OF THE PREFERRED EMBODIMENTS

Figure 12:
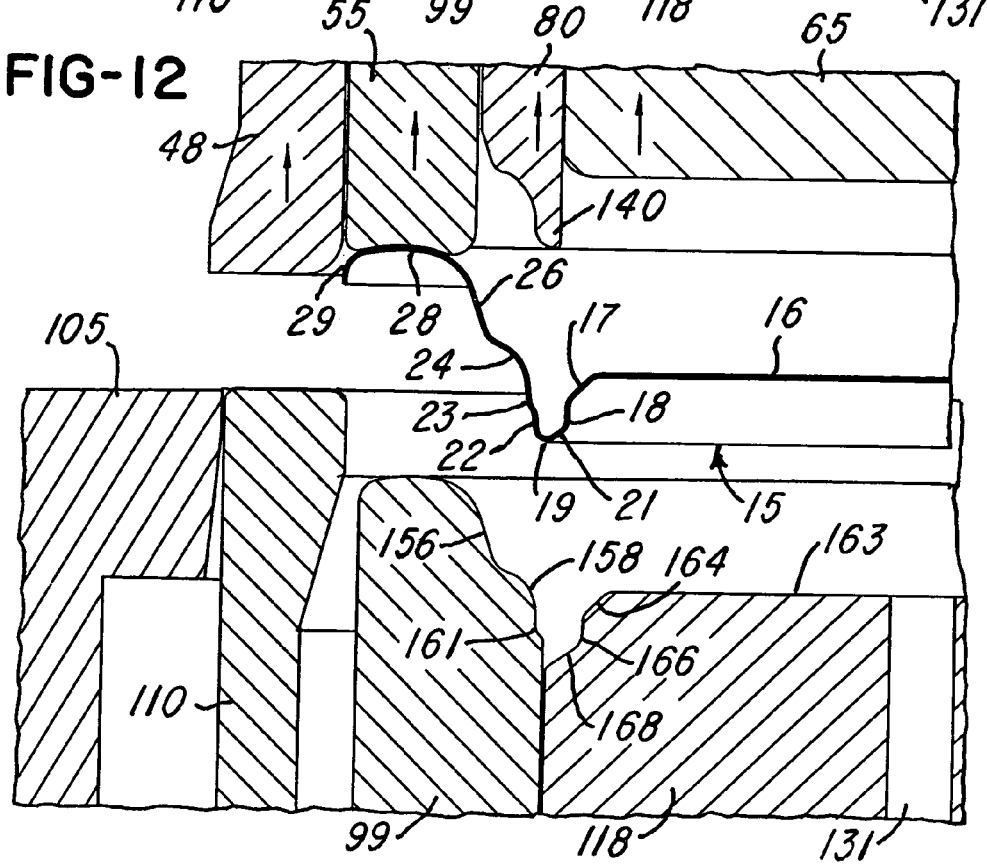

Referring to FIG. 12, a greatly enlarged shell 15 is formed from sheet metal or aluminum having a thickness of about 0.0082 inch. The shell 15 includes a flat circular center panel 16 which is connected by a frusto-conical or tapered annular panel wall portion 17 and a substantially cylindrical panel wall portion 18 to an annular countersink 19 having an inclined or frusto-conical inner wall portion 21 and generally a U-shaped cross-sectional configuration. The countersink 19 has a slightly inclined annular outer wall portion 22 connected to an annular lower chuckwall portion 23 and an annular upper chuckwall portion 24 having a curved cross-sectional configuration. The curved upper wall portion 24 of the chuckwall connects with an inclined or frusto-conical annular inner wall portion 26 of a crown portion 28 having a downwardly curved outer peripheral lip portion 29. The cross-sectional configuration or profile of the shell 15 is more specifically disclosed in applicants' above-mentioned published patent application No. US-2005-0029269. However, the method and apparatus of the invention may also be adapted to produce shells having different profiles.

Figure 1:
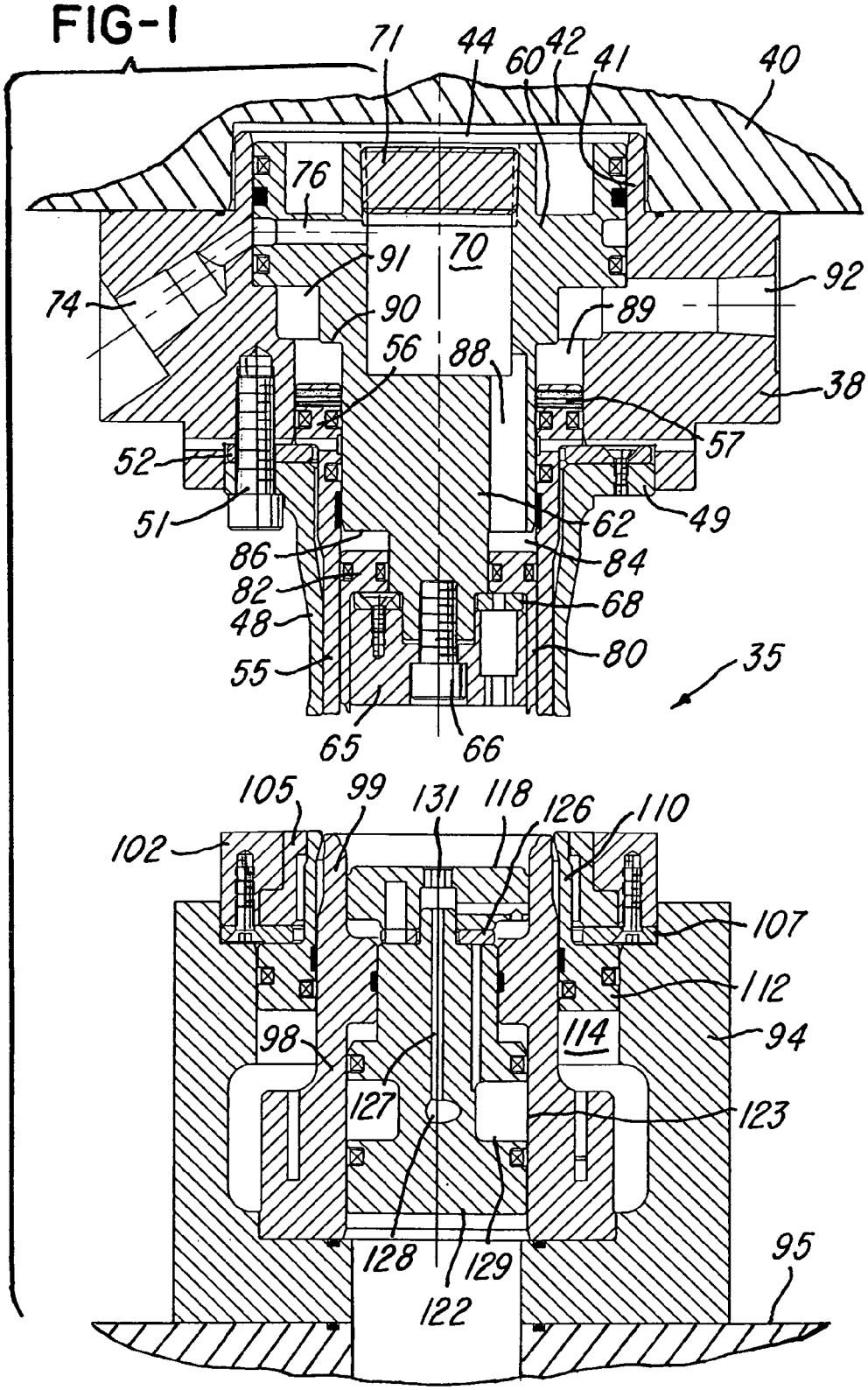
FIG. 1 is an axial section of a tooling assembly constructed and operated in accordance with the invention.

Referring to FIG. 1, a tooling assembly 35 includes an annular upper retainer 38 which is mounted on an upper die shoe 40 of a single action mechanical press. The retainer 38 has a cylindrical portion 41 which projects upwardly into a mating cavity 42 of the upper die shoe 40 and defines a pressurized air chamber 44. An annular blank and draw die 48 has an outwardly projecting upper flange portion 49 which is secured to the retainer 38 by a set of circumferentially spaced screws 51. A flat ground annular spacer 52 is secured to the upper flange portion of the blank and draw die 48 and provides for precisely spacing the die axially 48 relative to the upper retainer 38.

An annular outer pressure sleeve 55 is supported for axial movement within the blank and draw die 48 and includes an integrally formed piston 56 having radial plastic wear pins 57. A die center piston 60 may be supported for axial movement within the upper retainer 38 and includes a lower portion 62 which supports a die center punch 65 removably secured to the die center piston 60 by a center cap screw 66. A flat ground annular spacer 68 is positioned between the die center punch 65 and a shoulder on the lower portion 62 of the die center piston 60 to provide for precisely selecting the axial position of the die center punch on the die center piston 60. A cylindrical pressurized air reservoir chamber 70 is formed within the center portion of the die center piston 60 and is closed at the top by a threaded plug 71. The reservoir chamber 70 receives pressurized air through a port 74 formed within the retainer 38 and an aligned radial passage 76 formed within the die center piston 60.

An annular inner pressure sleeve 80 is supported for axial movement within the outer pressure sleeve 55 and includes an integral piston 82 confined within an annular air piston chamber 84 defined axially between the piston 82 and a radial shoulder 86 on the lower portion 62 of the die center piston 60. The air piston chamber 84 receives pressurized air through a plurality of three circumferentially spaced air passages 88 which extends axially from the shoulder 86 to the air reservoir chamber 70 within the die center piston 60. Suitable two piece air seal rings are carried by the piston 82 of the inner pressure sleeve 80 and also the piston 56 of the outer pressure sleeve 55 as well as by the upper portion of the die center piston 60. The piston 56 of the outer pressure sleeve 55 is confined within an annular air pressure chamber 89 which extends to a stop shoulder 90 and connects with an annular air chamber 91. The chambers 89 & 91 receive pressurized air through a port 92 in the retainer 38.

The tooling assembly 35 also includes a fixed annular lower retainer 94 which is mounted on a stationery lower die shoe 95 of the single action press. The lower retainer 94 supports a fixed die core ring 98 having an annular upper portion 99 and also supports a fixed annular retainer 102 which confines an annular cut edge die 105. A flat annular ground spacer 107 is secured to the retainer 102 to confine the cut edge die 105 and provides for precisely positioning the cut edge die axially with respect to the upper annular portion 99 of the die core ring 98. An annular lower pressure sleeve 110 is positioned between the cut edge die 105 and the upper portion 99 of the die core ring 98 and has an integral piston 112 supported for axial movement within an annular pressurized air pressure chamber 114 defined between the lower retainer 94 and die core ring 98. The chamber 114 receives pressurized air through a port (not shown) with the lower retainer 94.

A circular panel punch 118 is confined within the upper portion 99 of the die core ring 98 and is secured for axial movement with a panel punch piston 122 supported within a stepped cylindrical bore 123 formed within the die core ring 98. A flat annular ground spacer 126 is positioned between the panel punch 118 and the panel punch piston 122 to provide for precisely positioning the panel punch 118 axially on the piston 122. Suitable two piece air seal rings are carried by the lower pressure sleeve piston 112 and the panel punch piston 122 to form sliding air-tight seals. An axially extending air pressure passage 127 is formed within the center of the panel punch piston 122 and receives pressurized air through a cross passage 128 and an annular chamber 129. The passage 127 provides a jet of pressurized air upwardly through a center opening 131 within the panel punch 118 for holding the shell 15 against the outer pressure sleeve 55 as the sleeve moves upwardly near the end of the pressed stroke, as shown in FIG. 12, to provide for rapid lateral removal of the completed shell in a conventional manner.

Figure 2:
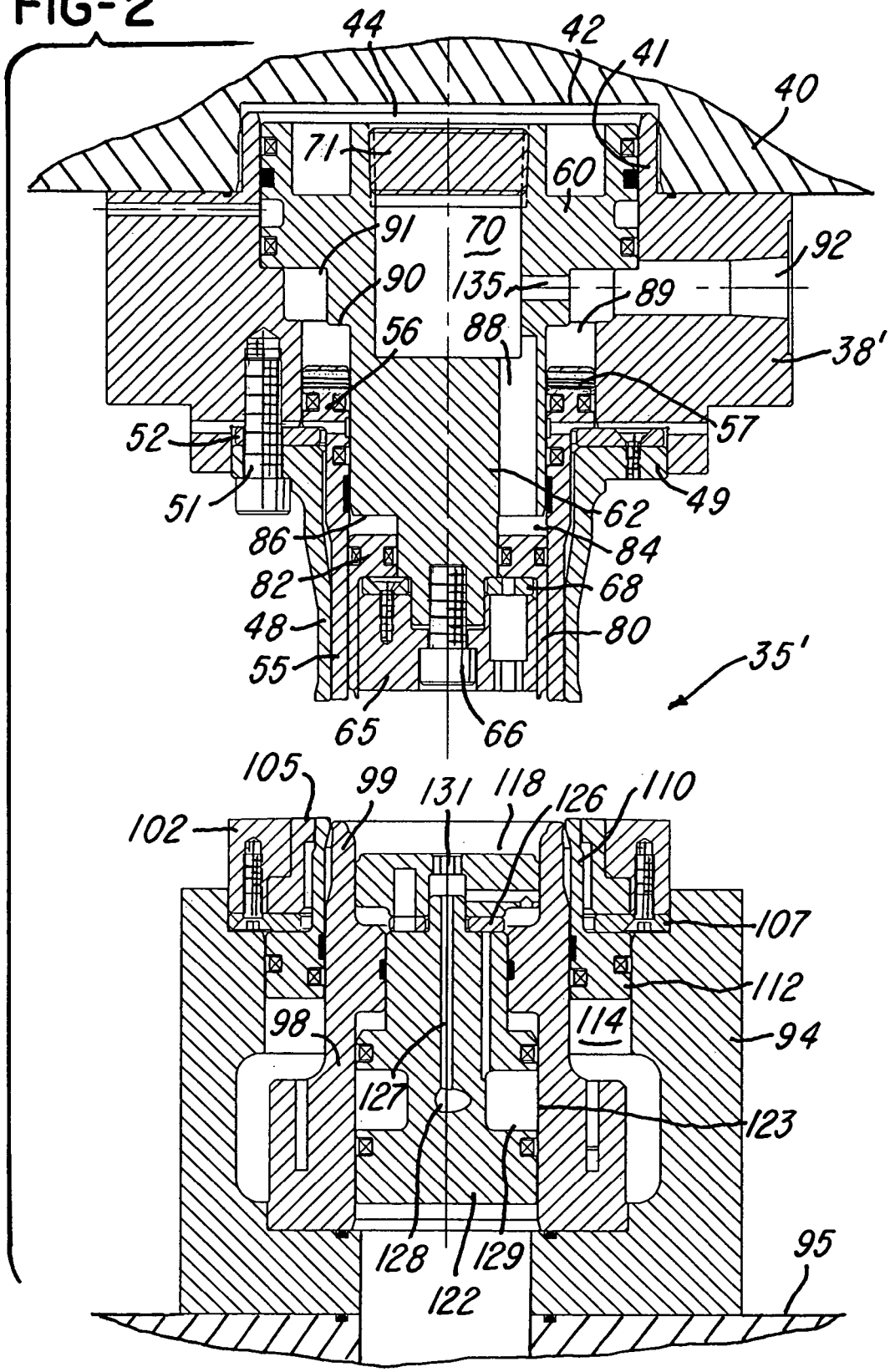
FIG. 2 is an axial section of the tooling assembly shown in FIG. 1 and constructed in accordance with a modification or another embodiment of the invention.

Referring to FIG. 2, a modified tooling assembly 35' is constructed the same as the tooling assembly 35 except that the air reservoir chamber 70 within the upper retainer 38' receives pressurized air through a passage 135 connected to the annular chamber 91 which receives pressurized air through the port 92. This pressurized air may be on the order of 125 to 170 p.s.i. so that the same air pressure is applied against the piston 56 of the outer pressure sleeve 55 and the piston 82 of the inner pressure sleeve 80. In comparison with the tooling assembly 35 of FIG. 1, the air reservoir chamber 70 receives pressurized air through the port 74 and passage 76 on the order of 160 to 170 p.s.i., whereas the piston 56 of the outer pressure sleeve 55 receives pressurized air through the port 92 on the order of 80 to 90 p.s.i.

Referring to the enlarged fragmentation views of FIGS. 3-12 which illustrate the operation of the tooling assembly 35 or 35' with each stroke of the single action press, the inner pressure sleeve 80 has a nose portion 140 which normally projects downwardly from the flat bottom surface of the die center punch 65 during the initial downstroke and the final up stroke of the upper die shoe 40. The nose portion 140 has an annular curved surface 143 which extends from a bottom curved end surface 144 to an inclined frusto-conical surface 147. The bottom end of the outer pressure sleeve 55 has a slightly curved or arcuate surface 151 which opposes and mates with an arcuate crown surface 153 formed on the upper end portion 99 of the die core ring 98. The upper end portion 99 of the die core ring 98 also has an inclined or frusto-conical surface 156, a curved annular surface 158 and a curved surface 161 which oppose and mates with the corresponding surfaces 147, 143 and 144 on the bottom of the inner pressure sleeve 80.

Figure 3:
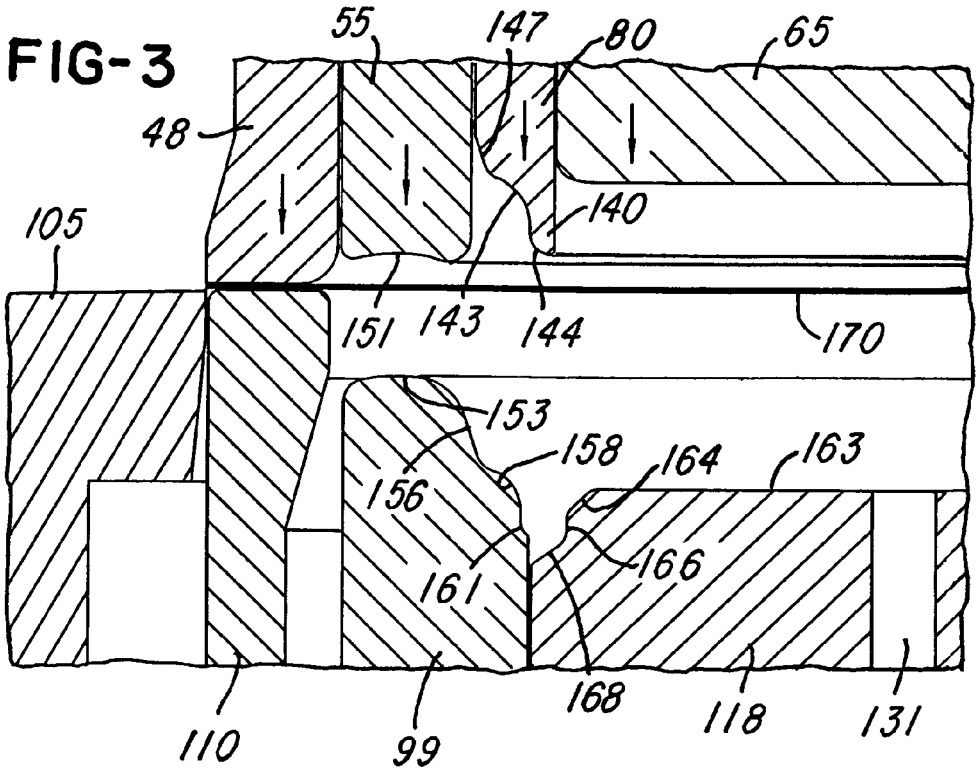
FIGS. 3-12 are enlarged fragmentary sections of the tooling assembly shown in FIGS. 1 and 2 and illustrating the progressive steps for producing a shell in accordance with the invention.
Figure 4:
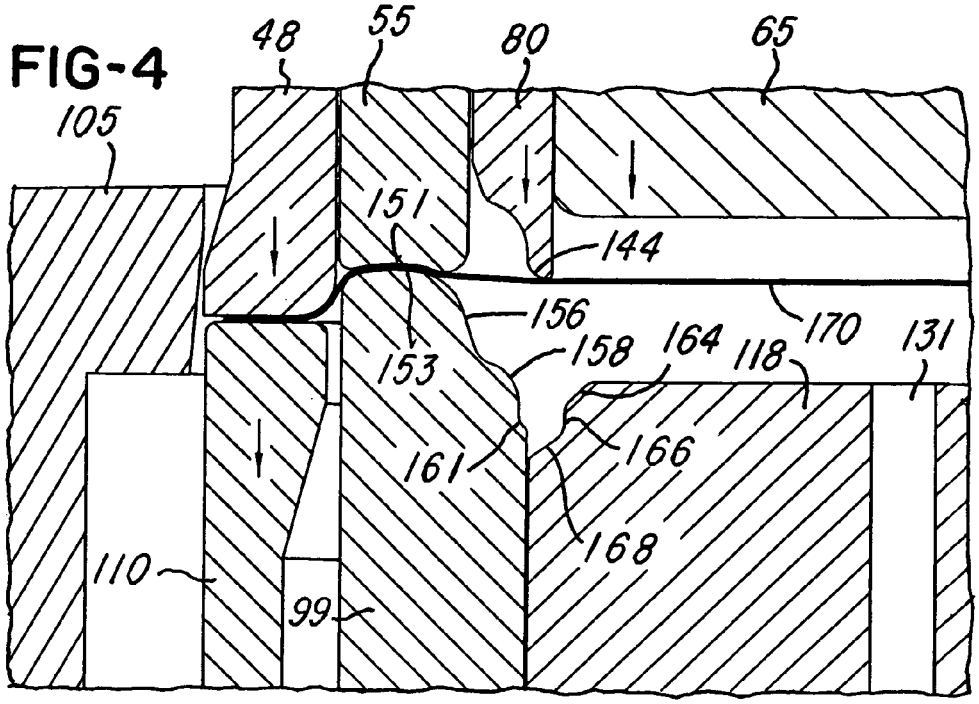

The panel punch 118 has a flat top circular surface 163 surrounded by a tapered on frusto-conical surface 164, a substantial cylindrical surface 166 and an outer tapered or frusto-conical surface 168 which opposes the end surface 144 on the nose portion 140 of the inner pressure sleeve 80. As shown in FIGS. 3 and 4, as the upper die shoe 40 commences its downstroke, the blank and draw die 48 cooperates with the cut edge die 105 to blank a substantially circular disk 170 of thin sheet metal or aluminum. Continued downstroke of the upper die show causes an annular portion of the disk 170 to be clamped between the outer pressure sleeve 55 and the die core ring 98 with controlled pressure as determined by the selected air pressure against the piston 56 of the outer pressure sleeve 55. The outer peripheral edge portion of the disk 170 is drawn downwardly around the upper end portion of the die core ring 98 by the downward movement of the blank and draw die 48 and the opposing lower pressure sleeve 110 with the clamping pressure controlled by the selected air pressure within the chamber 114 against the piston 112 of the lower pressure sleeve 110.

Figure 5:
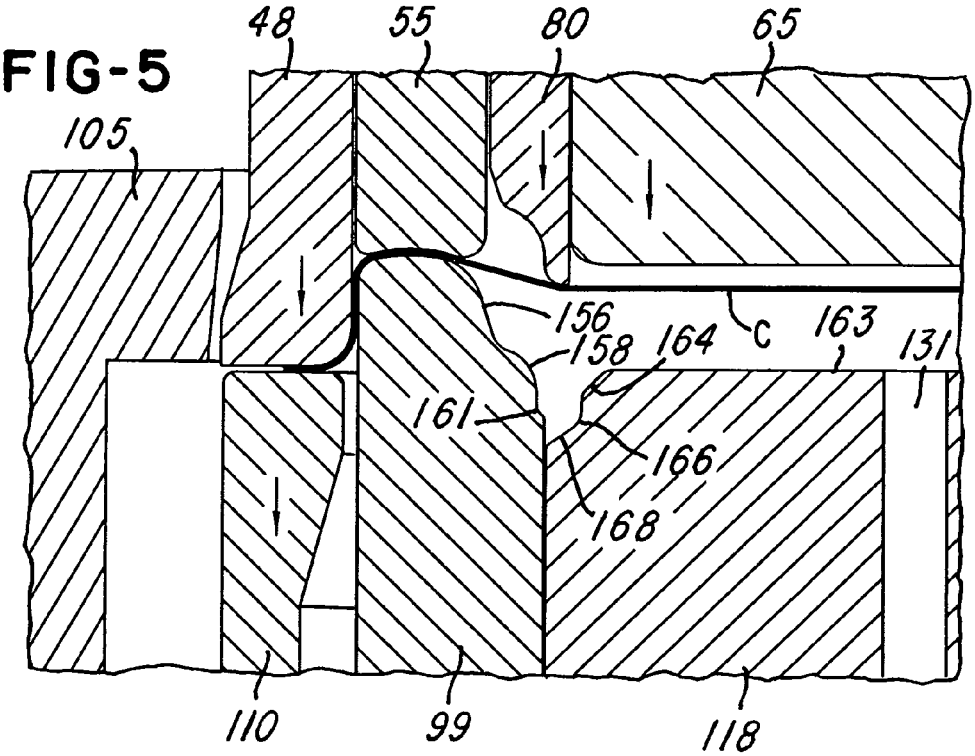
Figure 6:
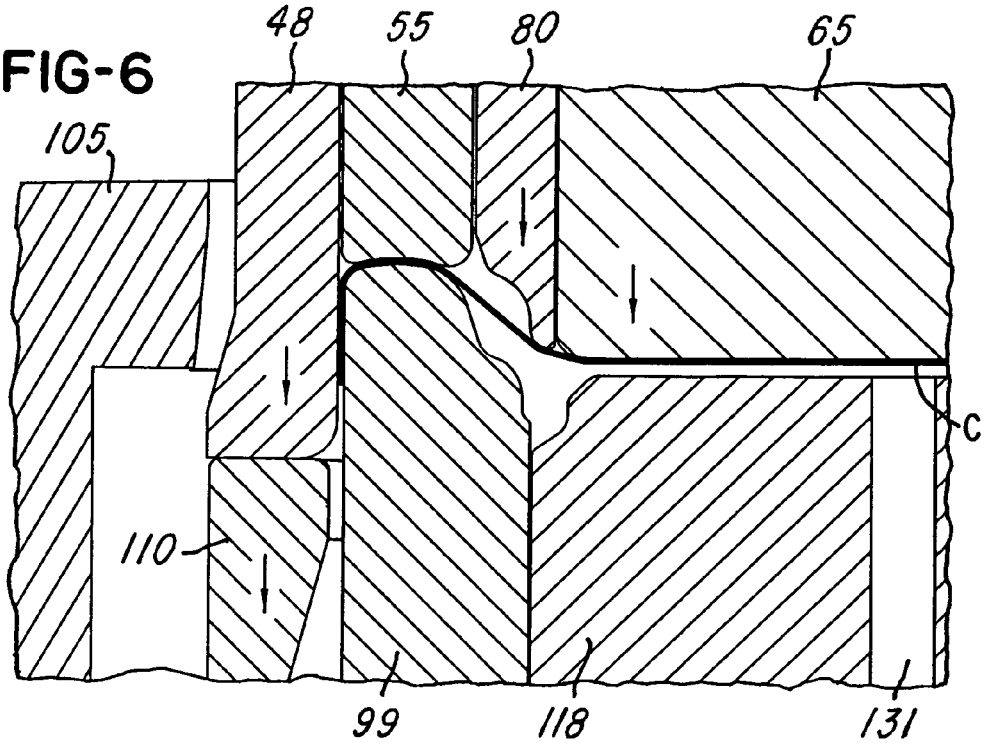
Figure 7:
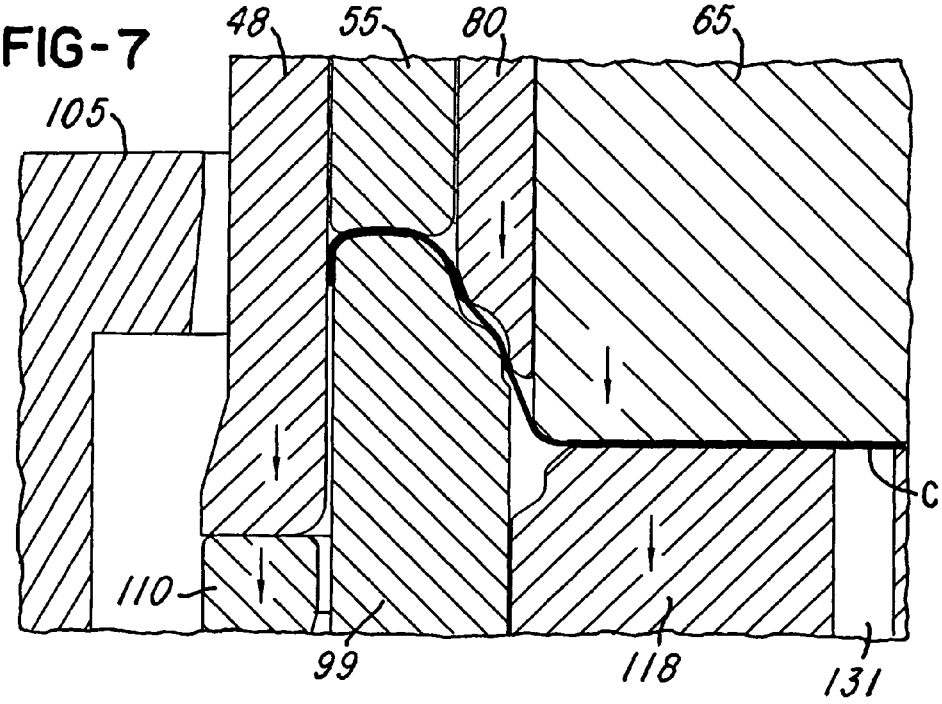
Figure 8:
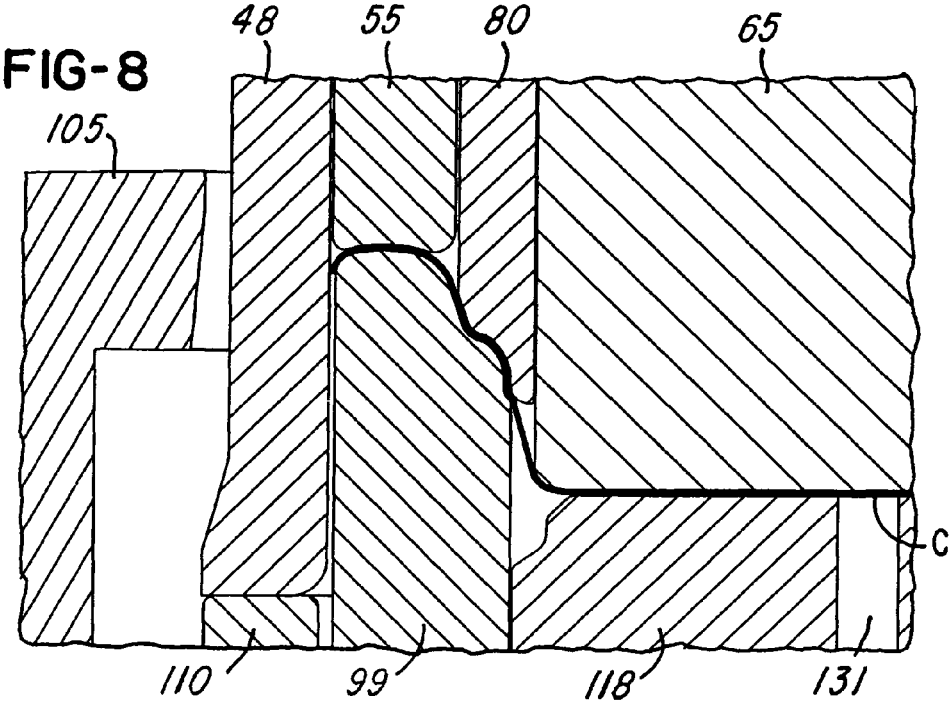
Figure 9:
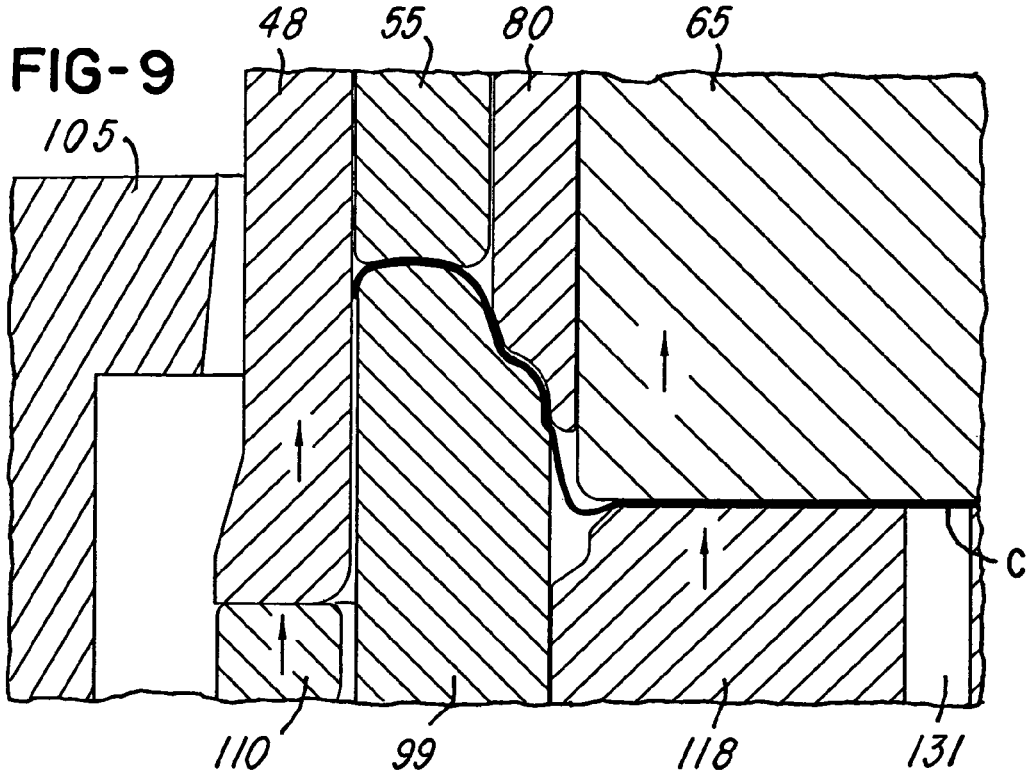

As shown in FIGS. 4 and 5, the projected nose portion 140 of the inner pressure sleeve 80 initiates the drawing of a cup portion C from a portion of the disk 150 within the outer pressure sleeve 55 and die core ring 98. Continuing downstroke of the upper die shoe 40 causes the die center punch 65 to cooperate with the inner pressure sleeve 80 to continue drawing of the cup portion C while the outer portion of the disk 170 slides between the outer pressure sleeve 55, the die core ring 95 and the blank and draw die 48. As shown in FIGS. 7 and 8, continued downstroke of the upper die shoe 40 causes the die center punch 65 to extend from the inner pressure sleeve 80 until the cup portion C contacts the top surface 163 of the panel punch 118. Simultaneously, the bottom contoured surfaces 143, 144 & 147 of the inner pressure sleeve 80 clamp an intermediate annular portion of the disk 170 against the mating contoured surfaces 158, 161 and 156 of the die core ring 98 to form the annular portions 22, 23, 24 and 26 (FIG. 12) of the shell 15. The crown portion 28 and outer curled lip portion 29 of the shell 15 are simultaneously formed on the die core ring 98 with a controlled force on the piston 56 of the outer pressure sleeve 55.

When the upper die shoe 40 of the single action press arrives at the bottom of its downstroke (FIG. 8) and the piston 56 stops on the shoulder 90, controlled air pressure within the chamber 44 above the die center piston 60 allows the die center piston 60 and die center punch 65 to move slightly upwardly such as by about 0.010 inch. In some presses, this assures that the overall height of all the final shells 15 is always constant and uniform. In other more precisely controlled presses, the die center piston 60 may be fixed to the retainer 38 or 38'.

Figure 11:
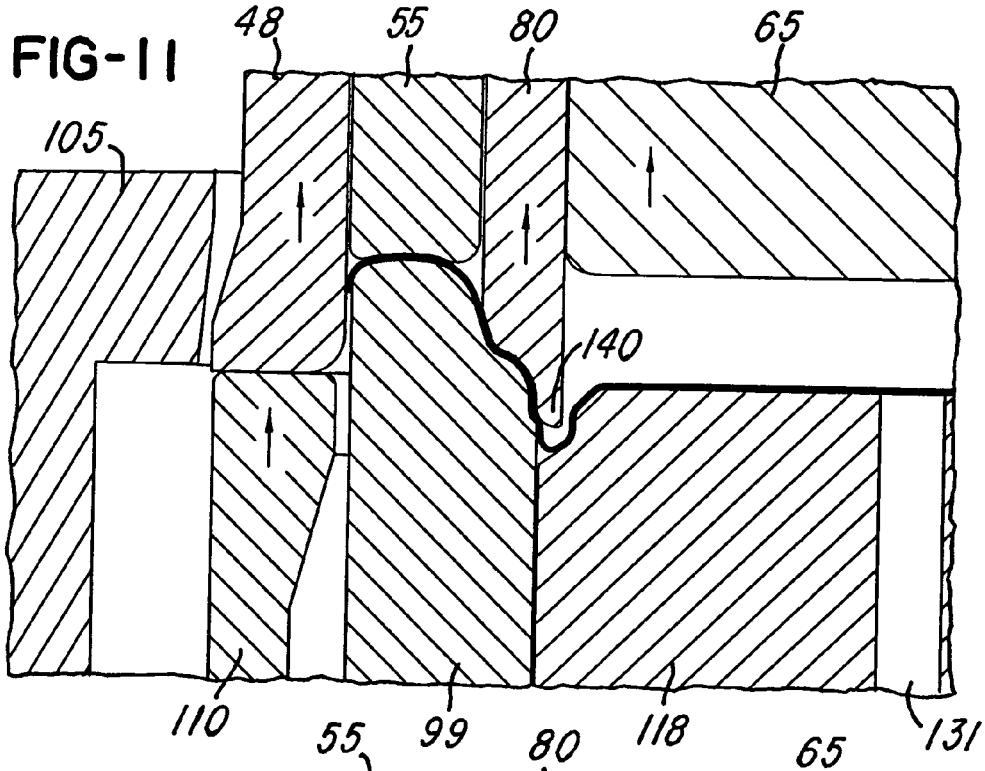

As the die shoe 40 starts the upstroke (FIG. 9), the die center punch 65 moves upwardly as does the panel punch 118 while the inner pressure sleeve 80 maintains a controlled constant pressure to hold the shell portions 22-24 and 26 between the mating surfaces on the inner pressure sleeve 80 and the die core ring 98. This controlled pressure of the inner pressure sleeve 80 is maintained while the panel punch 118 moves upwardly by the force exerted by the panel punch piston 122 so that the surfaces 164, 166 and 168 form the annular portions 17, 18, 19 and 21 on the shell 15, as shown in FIG. 11. As the upper die shoe 40 continues on its upstroke, the completed shell 15 moves upwardly from the die core ring 98 and panel punch 118 with the upward movement of the outer pressure sleeve 55 as a result of the air jet stream directed upwardly against the panel wall 16 through the hole 131 in the panel punch 118.

The construction and operation of the tooling assembly 35 or 35' has been found to provide the important and desirable features and advantages set forth above on page 1. For example, the compact tooling assembly is adapted to be operated on a single action mechanical press, and the reduced overall height of the tooling assembly enables the tooling assembly to be used in most single action high speed presses existing in the field. As another important advantage, the air reservoir chamber 70 and the set of circumferentially spaced air passages 88 within the die center piston 60 provide for using lower pressure air within the piston chamber 84, and the lower pressure air on the piston 82 of the inner pressure sleeve 80 reduces the generation of heat in the upper portion of the tooling assembly during high speed operation so that the tooling assembly produces more uniform and precise shells.

The pressurized air within the reservoir 70 and within the passages 88 also perform as air springs. These air springs not only reduce the generation of heat, but also provide for precisely selecting the resilient force exerted on the piston 82 of the inner pressure sleeve 80 to assure the desired precise clamping force on the disk 170 by the inner pressure sleeve 80 against the fixed die core ring 98. The tooling assembly 35 also permits the use of the lower pressure plant supply air, such as 80 to 90 p.s.i., to the piston 56 of the outer pressure sleeve 55, and the precisely controlled lower air pressure on the outer pressure sleeve avoids stretching of the sheet metal as the sheet metal slides between the outer pressure sleeve 55, the die core ring 98 and the blank and draw die during formation of the cup portion C.

Figure 10:
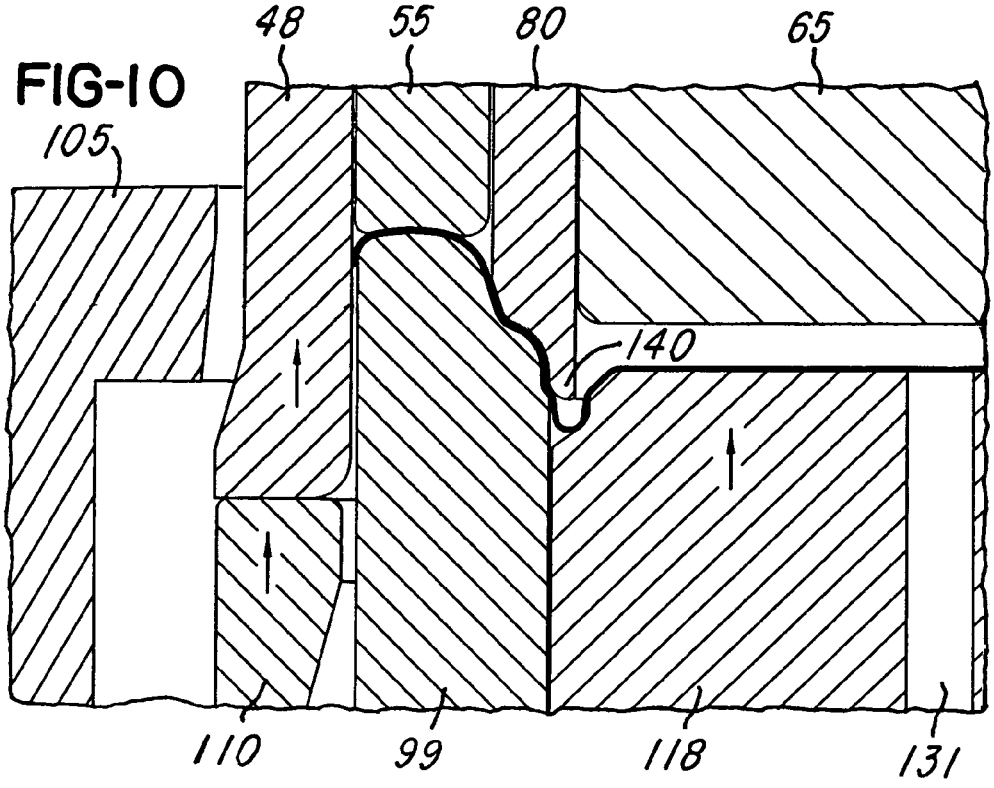

A further advantage is provided by the normal projection of the nose portion 140 of the inner pressure sleeve 80 below the die center piston 65 so that the nose portion initiates the forming of the cup portion C, as shown in FIG. 5. The nose portion 140 also assures precision formation of the annular portions 22-24 and 26 of the shell 15 without wrinkling, and these shell portions are held firmly between the mating surfaces of the inner pressure sleeve 80 and die core ring 98 during precision formation of the panel wall portions 17 and 18 and the formation of the countersink 19 including the inclined wall portion 21 during upward movement of the panel punch 118, as shown in FIG. 10. The above advantages are especially desirable when operating the tooling assembly of the invention in a single action press at high speed such as 650 strokes per minute with a press stroke of about 1.75 inch.

While the apparatus or tooling assemblies herein described and their method of operation constitute preferred embodiments of the invention, it is to be understood that the invention is not limited to the precise tooling assemblies and method steps described, and that changes may be made therein without departing from the scope and spirit of the invention as defined in the appended claims.

What is claimed is:

1. A method of forming a cup-shaped circular can shell from a flat metal sheet with tooling installed within a single action mechanical press, the shell including a center panel connected by an annular panel wall to an annular countersink having a generally U-shaped cross-sectional configuration and with the countersink connected to an inner wall portion of an annular crown by an inclined annular chuckwall, the method comprising the steps of blanking a disk from the sheet between a blank and draw die and an opposing cut edge die, gripping an annular portion of the disk between an annular die core ring within the cut edge die and an opposing annular outer pressure sleeve supported within the blank and draw die by a die center piston, engaging an annular inner portion of the disk with an annular nose portion of an annular inner pressure sleeve supported within the outer pressure sleeve while the nose portion is projecting axially from a die center punch retracted within the inner pressure sleeve, pressurizing the inner pressure sleeve with air springs produced by air spring passages extending from an air reservoir chamber within the die center piston, initiating the drawing of a cup within the disk with the projecting nose portion of the inner pressure sleeve while the nose portion is projecting from the die center punch, thereafter engaging a center portion of the disk with the die center punch within the inner pressure sleeve, forming the chuckwall of the shell by continuing the drawing of the cup with the die center punch until the inner pressure sleeve clamps an inclined annular portion of the disk against the die core ring, pressing the center portion of the disk with the die center punch against a panel punch within the die core ring to form the center panel of the shell and to complete forming of the cup, and reversing the direction of the panel punch and the die center punch while continuing to clamp the chuckwall between the inner pressure sleeve and the die core ring to form the panel wall and countersink of the shell with a contoured surface on a peripheral portion of the panel punch.

2. A method as defined in claim 1 wherein the step of forming the chuckwall of the shell comprises forming a curved portion of the chuckwall between a contoured S-shape end surface on the inner pressure sleeve pressurized by the air springs and an opposing and mating contoured S-shape surface on the die core ring.

3. A method as defined in claim 1 and including the step of supplying air at a first pressure to the air reservoir chamber and the air spring passages within the die center piston for the inner pressure sleeve, and supplying air at a second pressure lower than the first pressure to the outer pressure sleeve supported by the die center piston.

4. A method as defined in claim 1 and including the step of supplying air at a first pressure to the air reservoir chamber and the air spring passages within the die center piston for the inner pressure sleeve, and supplying air at the same first pressure to the outer pressure supported by the die center piston.

* * * * *